US009592421B2

(12) United States Patent
Eder

(10) Patent No.: US 9,592,421 B2
(45) Date of Patent: Mar. 14, 2017

(54) RECUMBENT HAND AND FOOT PEDAL EXERCISE APPARATUS WITH SEAT ACCOMMODATING A WHEELCHAIR

(71) Applicant: IncludeFitness, Inc., Columbus, OH (US)

(72) Inventor: James Ryan Eder, Columbus, OH (US)

(73) Assignee: INCLUDE FITNESS INC., Columbus, OH (US)

( * ) Notice: Subject to any disclaimer, the term of this patent is extended or adjusted under 35 U.S.C. 154(b) by 0 days.

(21) Appl. No.: 14/716,109

(22) Filed: May 19, 2015

(65) Prior Publication Data

US 2015/0328496 A1 Nov. 19, 2015

Related U.S. Application Data

(60) Provisional application No. 62/000,258, filed on May 19, 2014.

(51) Int. Cl.

| | |
|---|---|
| ***A63B 22/12*** | (2006.01) |
| ***A63B 21/00*** | (2006.01) |
| ***A63B 23/12*** | (2006.01) |
| ***A63B 23/04*** | (2006.01) |
| ***A63B 21/005*** | (2006.01) |
| ***A63B 21/012*** | (2006.01) |
| ***A63B 22/00*** | (2006.01) |
| ***A63B 22/06*** | (2006.01) |

(Continued)

(52) U.S. Cl.

CPC ..... *A63B 22/0005* (2015.10); *A63B 21/0058* (2013.01); *A63B 21/012* (2013.01); *A63B 21/1465* (2013.01); *A63B 21/1469* (2013.01); *A63B 21/1496* (2013.01); *A63B 22/0046* (2013.01); *A63B 22/0694* (2013.01); *A63B 23/0476* (2013.01); *A63B 23/12* (2013.01); *A63B 24/0075* (2013.01); *A63B 2022/0635* (2013.01); *A63B 2022/0647* (2013.01); *A63B 2022/0652* (2013.01); *A63B 2024/009* (2013.01); *A63B 2071/0018* (2013.01); *A63B 2208/0204* (2013.01); *A63B 2208/0228* (2013.01); *A63B 2210/50* (2013.01); *A63B 2220/20* (2013.01); *A63B 2220/51* (2013.01);

(Continued)

(58) Field of Classification Search

CPC ..... A63B 2210/00–2210/58; A63B 22/0002; A63B 22/0012; A63B 22/0033; A63B 22/0035; A63B 22/06; A63B 22/0605; A63B 23/0476; A63B 23/12; A63B 23/1209; A63B 23/1245; A63B 23/14; A63B 23/16

USPC ..... 482/62

See application file for complete search history.

(56) References Cited

U.S. PATENT DOCUMENTS 3,738,649 A * 6/1973 Miller ..... A63B 21/04 482/130

3,874,657 A * 4/1975 Niebojewski ..... A63B 17/00 482/104

(Continued)

*Primary Examiner* — Loan H Thanh

*Assistant Examiner* — Gregory Winter

(74) *Attorney, Agent, or Firm* — Jason H. Foster; Kremblas & Foster

(57) ABSTRACT

An exercise apparatus having a cabinet housing to which a telescopically and angularly moveable arm is mounted. A hand pedal assembly is mounted to the arm and drivingly linked to a resistance mechanism. A platform is telescopically mounted to the bottom of the cabinet, and a foot pedal assembly is adjustably mounted to the platform. A seat is mounted to the far end of the platform from the cabinet, and the platform can be moved so the seat, the foot pedal assembly, or at least portions of both, can be inserted into a chamber of the cabinet.

4 Claims, 5 Drawing Sheets

(51) Int. Cl.
*A63B 24/00* (2006.01)
*A63B 71/00* (2006.01)

(52) U.S. Cl.
CPC ..... *A63B 2220/56* (2013.01); *A63B 2225/09* (2013.01); *A63B 2225/093* (2013.01); *A63B 2225/10* (2013.01); *A63B 2225/50* (2013.01)

(56) References Cited

U.S. PATENT DOCUMENTS 4,152,005 A 5/1979 Vanore
4,976,426 A * 12/1990 Szabo ..... A63B 21/00178 482/111
5,595,557 A 1/1997 Lambert, Sr. et al.
7,625,318 B1 * 12/2009 Heyn ..... A63B 21/4013 482/100
7,972,249 B1 * 7/2011 Napalan ..... A63B 21/0628 482/106
2004/0198563 A1 10/2004 Howell et al.
2005/0143226 A1 * 6/2005 Heidecke ..... A63B 21/0053 482/62
2007/0129219 A1 * 6/2007 Mahlberg ..... A61H 1/0214 482/62
2008/0085819 A1 * 4/2008 Yang ..... A63B 21/015 482/62
2009/0017997 A1 1/2009 Piggins
2014/0210218 A1 7/2014 Eder
2014/0364284 A1 * 12/2014 Moschel ..... A63B 22/0605 482/97

* cited by examiner

Fig. 1
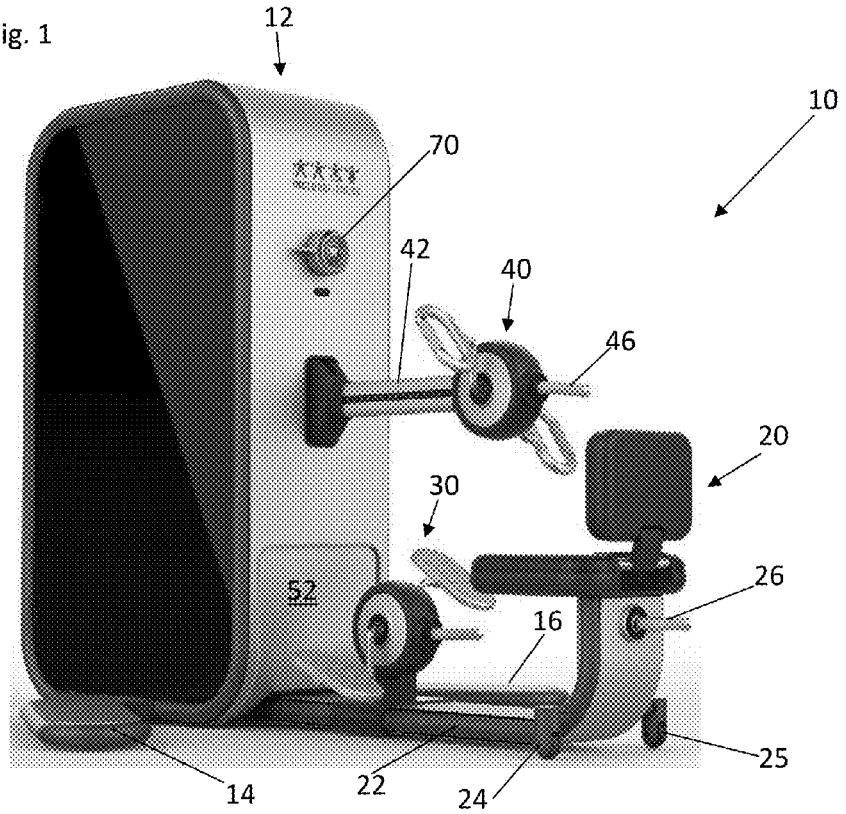
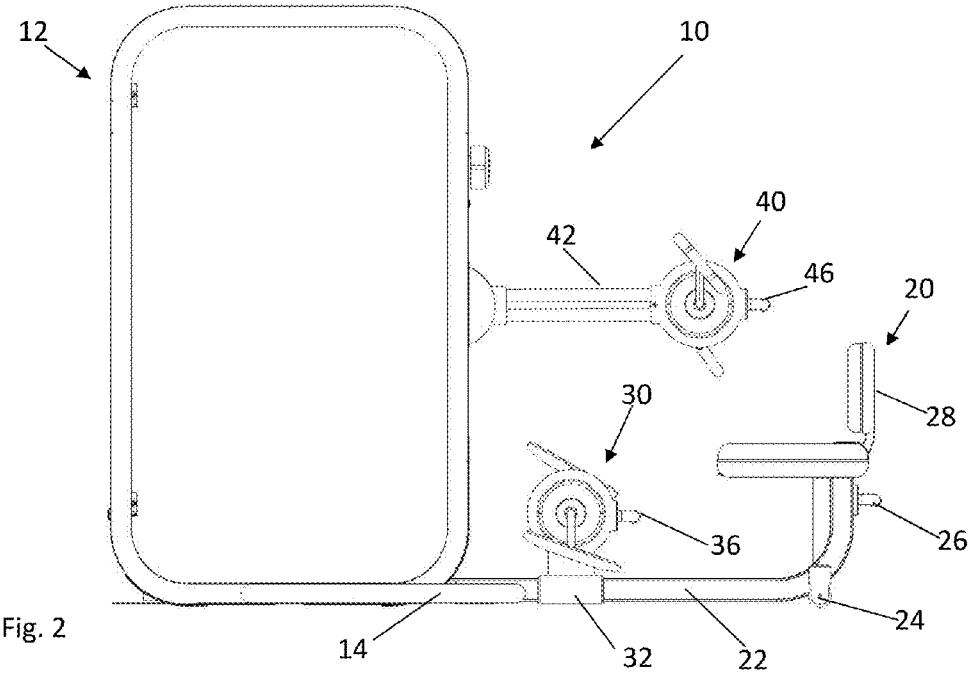
Fig. 2

RECUMBENT HAND AND FOOT PEDAL EXERCISE APPARATUS WITH SEAT ACCOMMODATING A WHEELCHAIR

CROSS-REFERENCES TO RELATED APPLICATIONS

This application claims the benefit of U.S. Provisional Application No. 62/000,258 filed May 19, 2014. The prior application is hereby incorporated by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

This invention relates generally to exercise equipment and more particularly to a hand and foot pedal apparatus with a seat that is readily moved by its user.

While conventional hand and/or foot pedal exercise machines are designed to be accessible to users, they often incorporate features that require significant strength, dexterity, and multiple extremities to adjust. These features make it difficult for someone with limited mobility or dexterity to effectively use the machine. For example, a wheelchair-bound person may not be able to position himself or herself while removing a seat to gain access for the wheelchair.

While traditional hand and/or foot pedal exercise machines offer the physical space needed to accommodate a wheelchair user, they do not accommodate standing, seated, and wheelchair users of exercise machines. On machines that accommodate wheelchair and non-wheelchair users, the ease of use to transition from one setup to the other is poor, and often requires the assistance of another person. Therefore, there is a need for an all-inclusive hand and leg bicycle exercise machine that can be independently used with ease regardless of size, age, mobility or fitness levels and from a standing, seated and wheelchair position.

It is therefore desirable to have a hand and foot pedaling machine that can be easily and effectively used by handicapped individuals and non-handicapped individuals alike that is able to facilitate a wide variety of different exercises, and adjust with very little strength or dexterity required.

BRIEF SUMMARY OF THE INVENTION

A combination ergometer and recumbent bicycle exercise machine is disclosed that utilizes features and benefits that permit use by people with and without the need to be in a wheelchair. The hand pedal and foot pedal assembly may communicate with digital health software platform services to provide real-time analytics and integration of the user's cardiovascular routines and therapy, if such a feature is desired.

This cardiovascular exercise machine features unique systems, including an ergometer and recumbent bicycle. Both of these systems can be used independently or in tandem and have a resistance mechanism that can be adjusted to the user's preference. The ergometer, or hand bike, housing has the ability to move up and down or in and out relative to the main tower cabinet. The recumbent bicycle housing can move in and out of the cabinet because it is attached to the movable seat assembly. In addition, the recumbent bicycle housing moves independently along the seat assembly to adjust to the user's body size.

This machine allows users to operate the hand-pedaled ergometer standing, seated on the seat provided, seated in a wheelchair, or seated while using the foot pedal assembly. The recumbent bike housing and seat can be used individually. The hand pedal and/or the foot pedal assemblies can be self-driven to provide guided movement for users who cannot move the systems manually.

BRIEF DESCRIPTION OF THE SEVERAL VIEWS OF THE DRAWINGS

FIG. 1 is a view in perspective illustrating an embodiment of the present invention.

FIG. 2 is a side view illustrating the embodiment of FIG. 1.

Figure 3:
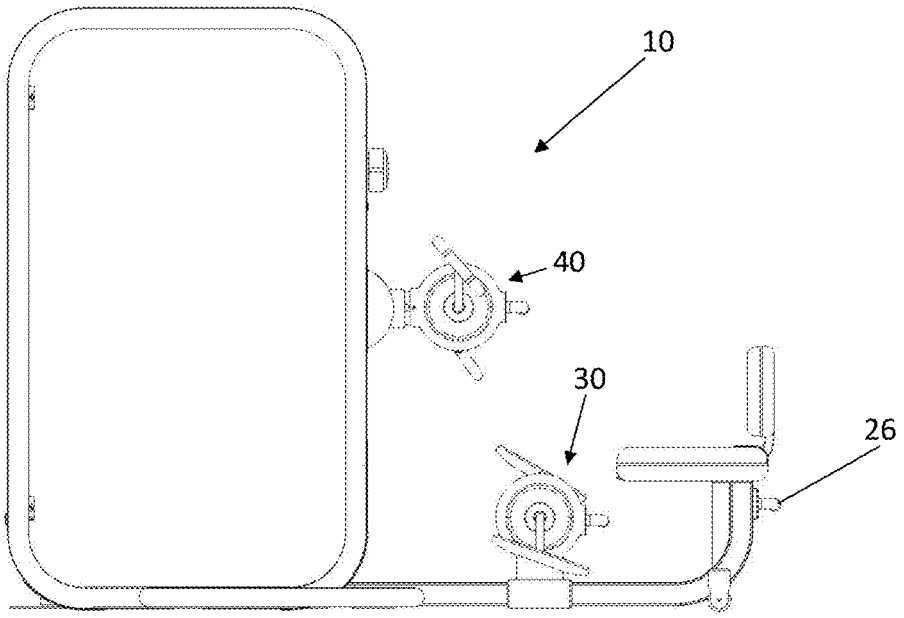
FIG. 3 is a side view illustrating the embodiment of FIG. 1 with the hand pedal pushed into the cabinet.
Figure 4:
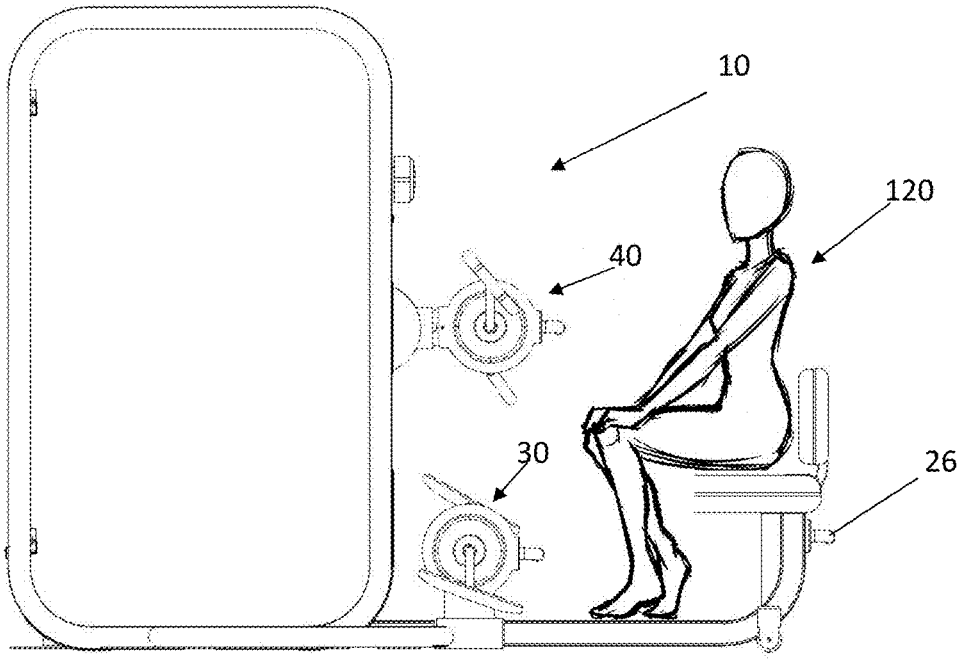
FIG. 4 is a side view illustrating the embodiment of FIG. 1 with the foot pedal pushed toward the cabinet.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

Patent application Ser. No. 62/000,258, filed May 19, 2014, is incorporated in this application by reference.

An exercise machine 10 embodying the invention is shown in FIG. 1 having a housing, such as the cabinet 12, that rests on a floor or other supportive surface. The cabinet 12 contains many components within a major chamber formed in the cabinet 12, and many of these components are preferably not visible from the exterior of the machine 10. The cabinet 12 serves as a structure to which other components attach, as will become apparent from the description herein. The cabinet may have an internal framework made of steel beams welded or otherwise fastened together with plastic panels mounted thereto as a covering for aesthetic, manufacturing and/or safety purposes. The cabinet may have a configuration that is taller than it is thick and wide, and that is wider than it is thick. The cabinet may have a height of about six feet, which is on the order of a human-user's height. The width may be about four feet, and the thickness may be about two feet.

The cabinet 12 preferably has a pair of laterally-extending legs 14 and 16 that support the cabinet against forces applied in the lateral direction, which is in relation to the user's position facing the cabinet 12 from seat 20. In this position, the user will face the cabinet at its thinnest side with the height of the cabinet extending upwardly from the user's feet, and the lateral direction being to the user's sides.

Looking now to FIG. 2, the machine 10 has a platform 22 that extends substantially horizontally from the cabinet 12 and preferably rigidly mounts to the frame of the cabinet 12. The platform 22 is a rigid, preferably hollow, body that extends between the legs 14 and 16 and directly beneath the cabinet 12. The platform 22 removably attaches to the lower portion of the frame of the cabinet in a manner that provides solid attachment when desired and permits movement along the platform's 22 longitudinal axis when desired. In a preferred embodiment, the platform 22 has casters 24, 25 or other structures that support the platform and attached seat 20 against vertical forces applied to them, and allow sliding or rolling of the platform and seat in a horizontal plane. The platform 22 is preferably mounted to the cabinet's framework in a way that allows linear movement substantially horizontally relative to the cabinet 12, which is referred to herein as "telescopically mounted", to permit the platform 22, seat 20, and any structures mounted thereto to be moved into and out of a sub-chamber 50 formed in the cabinet 12 and described in more detail below.

A foot petal assembly 30 is adjustably mounted to the platform 22, and this connection to the platform 22 disposes the foot pedal assembly 30 moveably (toward and away from the cabinet 12) along the platform's length and permits rigidly fixing the foot pedal assembly 30 to the platform 22. One contemplated structure that allows adjustable mounting is a collar 32 that extends circumferentially around the platform 22 to surround the platform 22 while permitting sliding movement along the platform's length.

Upon rotation against a bias, a rotatable handle 36 on the seat side of the foot pedal assembly 30 housing withdraws a bolt, or actuates a mechanism that withdraws a bolt, from one of many upwardly-facing openings extending in a row along the top of the platform 22. This allows the assembly 30 to be manually displaced toward or away from the cabinet 12 along the axis of the platform 22. Upon release of the handle 36, the bolt inserts into the closest one of the openings to the bolt. Some of the different positions of the food pedal assembly 30 on the platform 22 are shown in FIGS. 1-4 and the foot pedal assembly 30 can be positioned at any position along the platform 22. The handle 36 and bolt are described in pending U.S. application Ser. No. 14/166,635, which is incorporated herein by reference. An alternative connecting structure includes a dovetail that fits within a groove formed in the platform 22. Other alternatives will become apparent to the person of ordinary skill, and it will become apparent that the foot pedal assembly 30 is thereby adjustably mounted relative to the cabinet 12, the platform 22, and the seat 20. This at least permits adjustment of the position of the foot pedal assembly 30 relative to the seat 20 so that users with longer legs or shorter legs can adjust to the appropriate position.

The foot pedal assembly 30 is a conventional assembly with a pair of pedals pivotably connected to a crankshaft that extends through the assembly 30 housing. The crankshaft is drivingly linked to a mechanical resistance device 150 (see FIG. 6), such as a friction brake, an impeller in a liquid, or another dashpot which may be inside the cabinet 12. For example, the crankshaft may have a sprocket around which a chain extends that extends downwardly to another sprocket that drives a driveshaft having a pulley around which a belt extends. The belt extends from the pulley through the platform's 22 hollow structure and into the cabinet 12, which contains a pulley of variable diameter that is mounted to an adjustable friction brake. Any equivalent linkage 152 can be substituted, as will be apparent to the person of ordinary skill from the description herein. In one embodiment, the friction brake can be adjusted by the user rotating a dial 70 that is connected to a central computer that actuates a solenoid that adjusts the braking pressure. Based on the distance from the foot petal assembly 30 to the variable pulley, the diameter of the variable pulley is established by a servo motor that is connected to the central computer that receives a signal from a foot pedal assembly sensor. In a preferred embodiment, the central computer is mounted in the cabinet 12, and is connected, such as wirelessly using Bluetooth or other wireless protocols, to connect to the components, the internet, and/or handheld computers, such as smartphones. Such smartphones may have applications running that control, or otherwise influence the operation of, the computer.

With the above-described apparatus, a driving link is established between the foot pedal assembly 30 and the mechanical resistance device in the cabinet. Of course, a mechanical resistance device can be mounted in the foot pedal assembly 30 housing. It will become apparent that a user sitting in the seat 20 can pedal the foot pedal assembly 30 pedals against the mechanical resistance to exercise, and that before, or after, pedaling the user can adjust the relative positions of the structures to suit his or her body size, preferences and physical limitations. It is contemplated that the height of the foot pedal assembly 30 can be adjusted.

Figure 5:
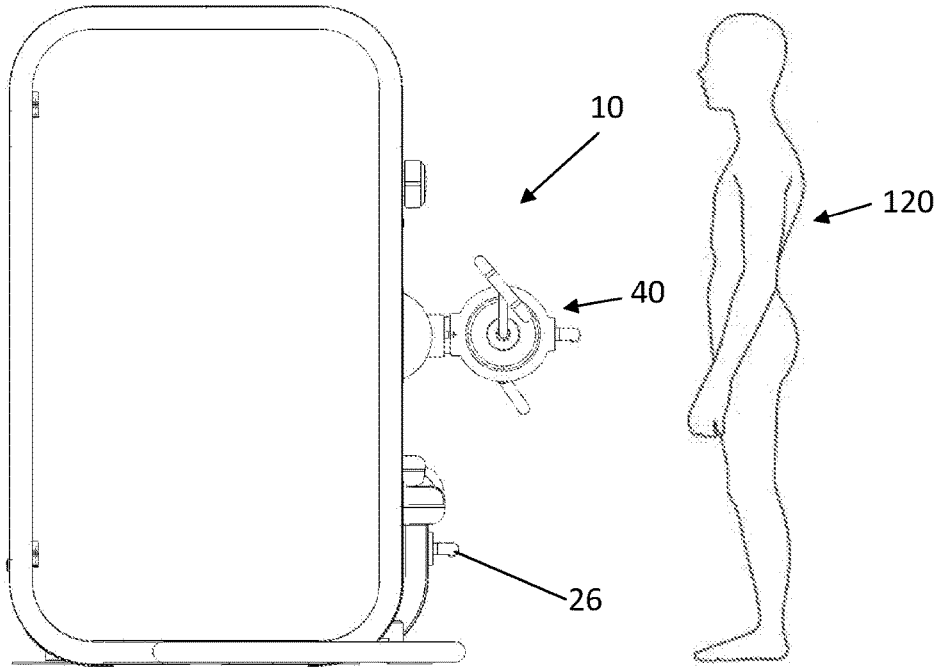
FIG. 5 is a side view illustrating the embodiment of FIG. 1 with the seat, foot pedal and platform pushed into the cabinet.
Figure 7:
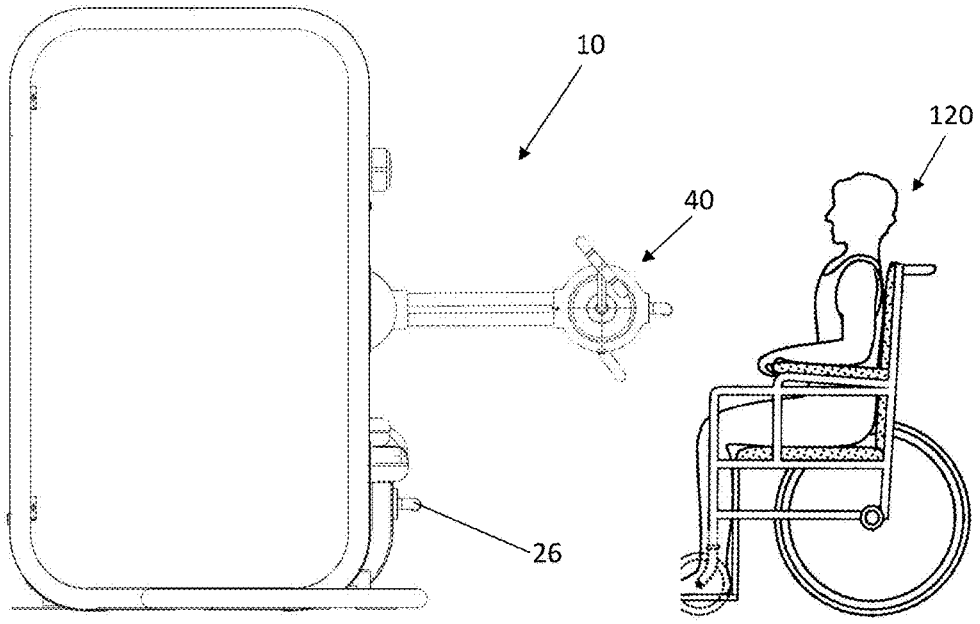
FIG. 7 is a side view in section illustrating the embodiment of FIG. 1 with the seat and foot pedal pushed into the cabinet and the hand pedal extended from the cabinet.
Figure 8:
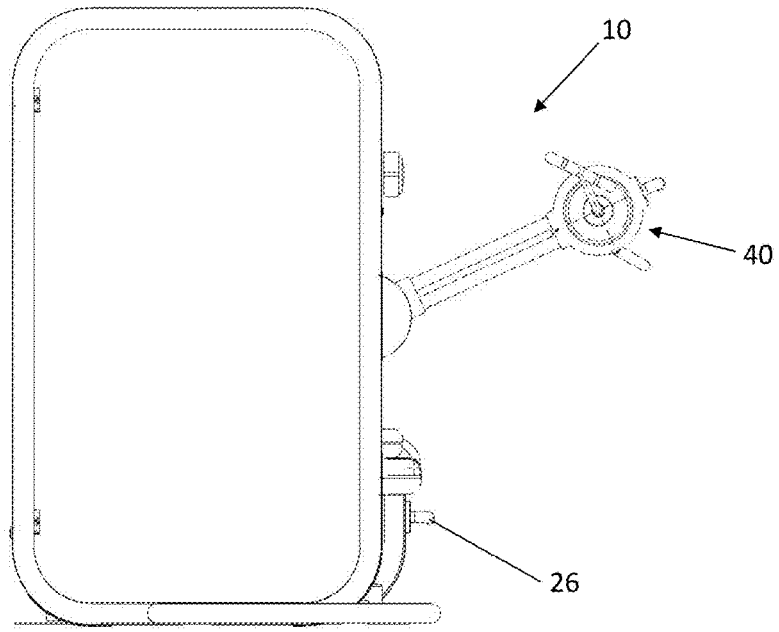
FIG. 8 is a side view in section illustrating the embodiment of FIG. 1 with the seat and foot pedal pushed into the cabinet and the hand pedal extended and angled upwardly from the cabinet.
Figure 9:
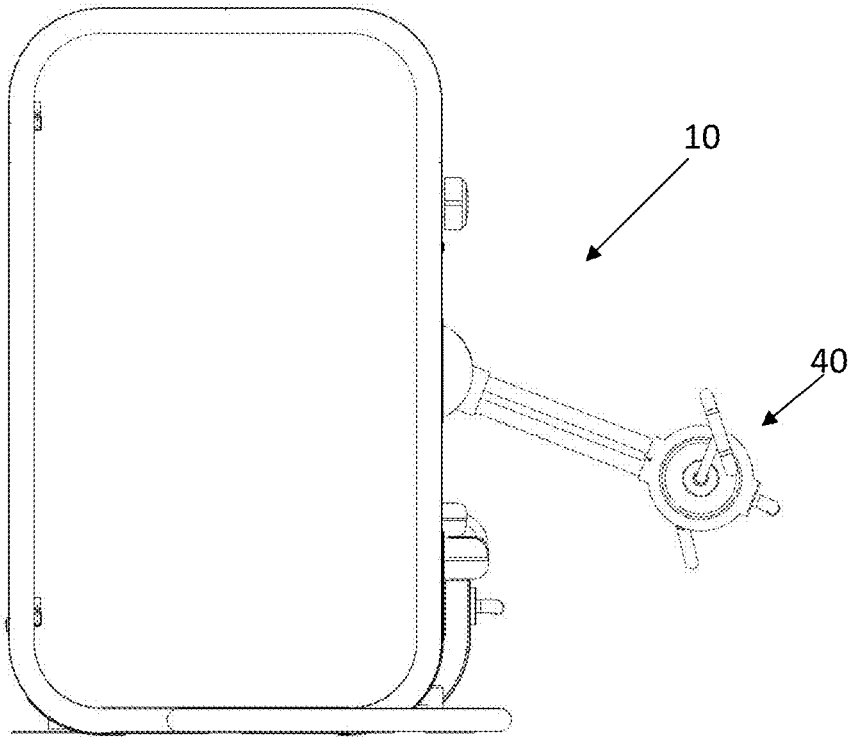
FIG. 9 is a side view in section illustrating the embodiment of FIG. 1 with the seat and foot pedal pushed into the cabinet and the hand pedal extended and angled downwardly from the cabinet.
Figure 10:
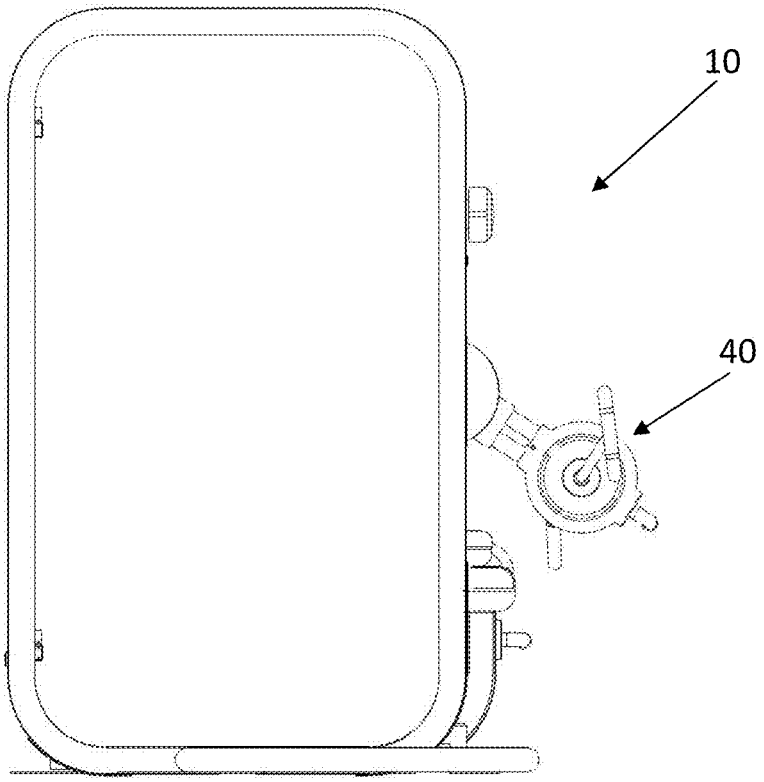
FIG. 10 is a side view in section illustrating the embodiment of FIG. 1 with the seat and foot pedal pushed into the cabinet and the hand pedal pushed into the cabinet and angled downwardly.

A hand pedal assembly 40 is mounted to an arm 42 that is preferably telescopically and pivotably (moveable to change the angle relative to the cabinet's 12 vertical axis) mounted to the cabinet 12, and more specifically the frame of the cabinet 12. The hand pedal assembly 40 is substantially similar to the foot pedal assembly 30, but with hand-grippable handles rather than pedals, and without the ability to be moved relative to the arm 42 (the hand pedal assembly 40 is rigidly mounted to the arm 42). Instead, preferably the arm 42 is moveable relative to the cabinet 12, both telescopically, to permit movement into or out of the cabinet 12, and pivotably, to permit movement of the arm 42 upwardly and downwardly to form different angles relative to the narrow surface of the cabinet 12 that faces the user when using the machine, such as when seated in the seat 20, standing or sitting in a wheelchair. Examples of the different horizontal positions of the arm 42 can be seen in FIGS. 2, 3 and 7, and examples of the different angular positions of the arm 42 can be seen in FIGS. 7-10. The arm 42 can be positioned horizontally, or at any angle between about 0 and about 45 degrees from horizontal above or below horizontal. Likewise, at any of these angular positions, the arm 42 can extend telescopically entirely into the cabinet 12 as shown in FIGS. 3 and 10, entirely out of the cabinet 12 as shown in FIGS. 2, 8 and 9, or any distance or angle between those shown and described. At any of those distances extended telescopically from the cabinet 12, or angles that the arm 42 is angled, the hand pedal assembly 40 operates effectively by connecting a crankshaft to which the handles pivotably mount to a resistance mechanism 150. This resistance mechanism to which the hand pedal assembly 40 drivingly links may be within the hand pedal assembly 40 housing or the cabinet 12, and may be the same as, or different from, the resistance mechanism to which the foot pedal assembly 30 mounts as described above. Preferably, all resistance mechanisms are connected to, and controlled by, the central computer, and all sensors are connected to the central computer to at least receive data therefrom. Thus, the hand pedal assembly 40 may be used by a user 120 when seated in the seat 20 (FIG. 4), when in a wheelchair (FIG. 7), and/or when standing (FIG. 5).

Upon rotation against a bias, a rotatable handle 46 withdraws a fastener, or actuates a mechanism that withdraws a fastener, that allows the arm 42 to pivot at, and/or extend horizontally relative to, the arm's attachment to the cabinet's frame. This allows the arm 42 to be manually displaced telescopically toward or away from the cabinet 12 along the axis of the arm 42, and allows pivoting upwardly or downwardly relative to the cabinet 12. Upon release of the handle 46, the fastener attaches and fixes the arm 42 at that position for use during rotation of the handles of the hand pedal assembly 40. The handle 46 is described in pending U.S. application Ser. No. 14/166,635, which is incorporated above by reference.

The platform 22 is adjustably mounted telescopically to the frame of the cabinet 12, and its position relative to the cabinet 12 can be adjusted by rotating the handle 26. Upon rotation against a bias, the rotatable handle 26 withdraws a bolt, or actuates a mechanism that withdraws a bolt, from one of many openings extending in a row along the bottom of the cabinet 12 frame, thereby allowing the platform 22 to be manually displaced toward or away from the cabinet 12. Upon release of the handle 26, the bolt inserts into one of the openings. The handle 26 and bolt are described in pending U.S. application Ser. No. 14/166,635, which is incorporated above by reference.

Figure 6:
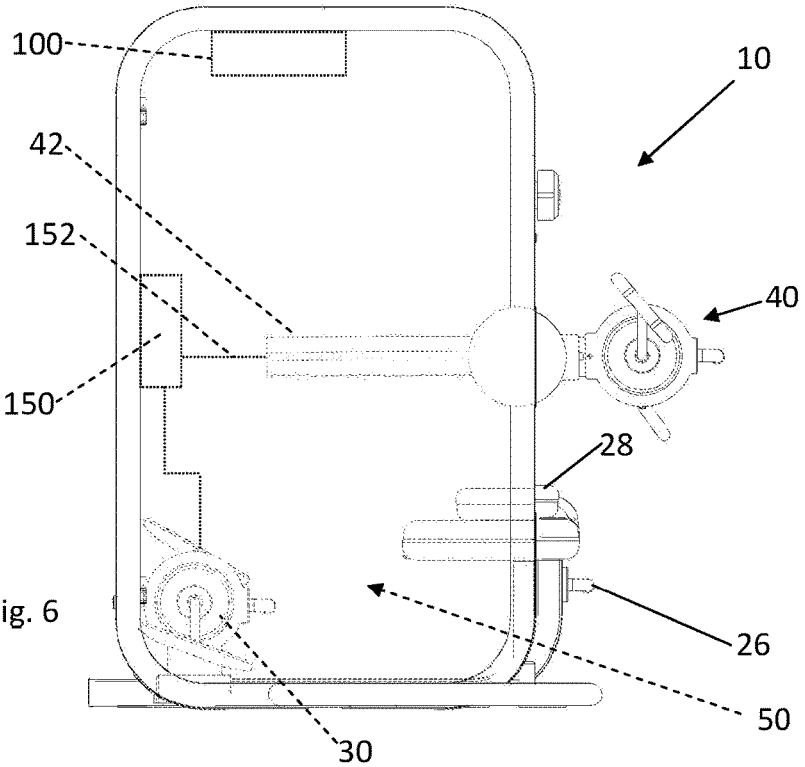
FIG. 6 is a side view in section illustrating the embodiment of FIG. 1 with the seat, foot pedal and platform pushed into the cabinet.

The telescopic adjustability of the platform 22 permits the user to adjust the distance of the seating surface of the seat 20 from the cabinet 12, the hand pedal assembly 40, and/or the foot pedal assembly 30. Once the position of the seat 20 is determined, the foot pedal assembly 30, if used, is adjusted, and the position of the hand pedal assembly 40, if used, is adjusted. Both assemblies 30 and 40 can be used simultaneously, for example by a user seated in the seat 20. If the seat 20 is not to be used, for example if the user is in a wheelchair so that the seat 20 becomes an obstacle, or the user wishes to stand and use the hand pedal assembly 40, the user can simply rotate the handle 26 and then slide the platform 22, seat 20, and foot pedal assembly 30 into a chamber 50 (see FIG. 6) within the cabinet 12, and preferably within the lower half of the cabinet 12. The same chamber 50, or another chamber, accommodates the arm 42 that extends telescopically into the cabinet 12. A door 52 (FIG. 1) is moved out of the way, such as by pivoting inwardly around a hinge mounted to the top or side of the door 52. A bias, such as a spring, may cause the door 52 to remain in the closed position shown in FIG. 1 until the foot pedal assembly 30 is pushed against the door 52, which displaces the door 52 inwardly to permit the foot pedal assembly 30 and the seat 20 to be inserted through the opening into the chamber 50. As shown in FIG. 6, the seatback 28 can be folded down to permit complete, or nearly complete, insertion of the seat 20 into the chamber 50. The seat also has a conventional height adjustment, and should be dropped to its lowest level before inserting into the chamber 50. The seat can be adjusted vertically by a handle beneath or located in close proximity to the seat, and that handle actuates a conventional gas cylinder as is found on conventional office chairs.

When a user wishes to use the hand pedal assembly 40 with the seat 20 inserted into the chamber 50 as shown in FIGS. 5-8, the hand pedal assembly 40 can be adjusted to any of the positions shown in FIGS. 5-8, or any position therebetween. Then the user can simply position his or her wheelchair into the desired location and operate the hand pedal assembly 40. The next user, if he or she wishes to use the seat 20, needs to merely rotate the handle 26, pull the handle 26 away from the cabinet 12, and this action rolls the seat 20 back into a position away from the cabinet 12 beneath the hand pedal assembly 40. Reversing these steps is how the seat 20 is returned into the chamber 50. The hand pedal assembly 40 can also be used while standing if the seat 20 is stored in the chamber 50.

The ability to place the seat into the chamber 50 by rotating a single handle 26 and pushing with one arm allows the seat 20 and foot pedal assembly 30 to stay attached to the cabinet 12, and prevents the seat from being lost, which could occur if it could be removed. Also, the movement of the seat 20 into and out of the chamber does not require two arms or lifting from a high position. Thus, one person can readily move the seat 20 into the chamber 50 and return the seat 20 to the position outside of the chamber 50.

As described above, and shown in FIG. 6, a central computer 100 is mounted in the cabinet 12. The computer 100 is connected to all sensors and resistance mechanisms on the machine 10, preferably wirelessly, but alternatively by a wired connection. The computer 100 can connect to a smartphone or other computer that the user is wearing or brings to the machine 10, and data can be transferred between the computer 100 and the smartphone in order to automatically start the machine 10 with that data, or to upload data from the computer 100 to the smartphone that relates to the workout.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An exercise apparatus comprising:

(a) a housing having a chamber formed therein with a chamber opening in a housing sidewall;

(b) a hand-pedal arm pivotably and telescopically mounted to the housing above the chamber opening;

(c) a hand-pedal assembly mounted to the hand-pedal arm and drivingly linked to at least one resistance assembly;

(d) an elongated platform having first and second opposing ends, the platform being longitudinally movably attached to the housing near the first end of the platform with the second end of the platform protruding out of the chamber opening to locate the platform directly beneath the hand-pedal assembly when in a platform protruding position;

(e) a foot-pedal assembly lengthwise movably mounted to the platform and drivingly linked to said at least one resistance assembly; and (f) a seat mounted to the second end of the platform for supporting a human user's weight;

wherein the chamber is sized to receive the foot-pedal assembly and at least a portion of the seat in a platform stowing position in which no portion of the platform is directly beneath the hand-pedal assembly, and a user sitting in a wheelchair may position the user at least partially directly beneath the hand-pedal assembly and may grasp and operate the hand-pedal assembly.

2. The exercise apparatus in accordance with claim 1, wherein, in the platform stowing position, the platform and the seat are substantially entirely within the chamber and the chamber opening.

3. The exercise apparatus in accordance with claim 1, further comprising wheels extending from the platform to a surface upon which the housing is supported.

4. The exercise apparatus in accordance with claim 1, further comprising a hand-grippable handle, the handle permitting actuation of a mechanism that locks the platform in the platform stowing position and the platform protruding position, and unlocks the platform to be moved between the platform stowing position and the platform protruding position.

* * * * *